United States Patent [19]

Suzuki

[11] Patent Number: 4,565,406

[45] Date of Patent: Jan. 21, 1986

[54] LUMBAR SUPPORT DEVICE

[75] Inventor: Hiroshi Suzuki, Akishima, Japan

[73] Assignee: Tachikawa Spring Co., Ltd., Tokyo, Japan

[21] Appl. No.: 715,086

[22] Filed: Mar. 22, 1985

[30] Foreign Application Priority Data

Mar. 29, 1984 [JP] Japan ..... 59-63060

[51] Int. Cl.[4] ..... A47C 7/46

[52] U.S. Cl. ..... 297/284; 297/460

[58] Field of Search ..... 297/284, 460; 267/89

[56] References Cited

U.S. PATENT DOCUMENTS

| | | | |
|---|---|---|---|
| 3,241,879 | 3/1966 | Costello et al. | 297/284 |
| 4,019,777 | 4/1977 | Hayashi | 297/284 |
| 4,162,807 | 7/1979 | Yoshimura | 297/284 |
| 4,296,965 | 10/1981 | Sakurada et al. | 297/284 |
| 4,449,751 | 5/1984 | Murphy et al. | 297/284 |

*Primary Examiner*—Francis K. Zugel

*Attorney, Agent, or Firm*—Darby & Darby

[57] ABSTRACT

A lumbar support device is disclosed in which a cam is rotated to longitudinally move an elastic member extending across the right and left sides of a back frame and thus vary the curvature of the elastic member in its longitudinal direction so as to be able to adjust the hardness of the lumbar support portion of a seat back forming part of a vehicle seat. The cam comprises a smaller cam portion mounted at the side of the elastic member to a shaft and a larger cam portion engaged coaxially and integrally with the smaller cam portion and provided at its side facing the smaller cam portion with a guide section having a concavo-convex curved surface with respect to the elastic member. The elastic member is pushed out in accordance with both displacements of the smaller cam portion and the guide section in the larger cam portion so that the curvature of the elastic member is varied accordingly.

5 Claims, 6 Drawing Figures

LUMBAR SUPPORT DEVICE

BACKGROUND OF THE INVENTION

1. Field of the Invention

The present invention relates to a lumbar support device for a vehicle seat and, more particularly, to such lumbar support device in which a cam is rotated to move one end of an elastic member extended across the right and left sides of a back frame of the seat in the longitudinal direction of the elastic member and thus to vary the curvature of the elastic member in its longitudinal direction so that the hardness of the lumbar support section of the vehicle seat can be adjusted.

2. Description of the Prior Art

A conventional lumbar support device of this type is illustrated in FIG. 1. In this conventional device, a plate cam (1) is rotated via a shaft of rotation (4) by turning a handle (3) projected from the side of a seat back, and such rotation of the plate cam (1) causes an elastic member (2) of a wire to be moved in its longitudinal direction to vary the curvature of the elastic member (2) so as to adjust the hardness of the lumbar support section of the seat back. In FIG. 1, reference numeral (5) designates a slide piece which fixes one end of the elastic member (2) and is engaged with the plate cam (1), and (6) represents a seat frame of the seat back.

In such conventional lumbar support device, however, since the loads of the elastic member are carried by one surface of the plate cam, heavy loads are necessary to operate the cam. In other words, such conventional device is disadvantages in that the adjustment of the hardness of the seat back lumbar support section can not be made smoothly.

SUMMARY OF THE INVENTION

The present invention aims at eliminating the drawbacks found in the above-mentioned conventional lumbar support device.

Accordingly, it is a primary object of the invention to provide an improved lumbar support device which eliminates the centralized load of an elastic member on a plate cam to reduce the load necessary to operate a handle.

In order to accomplish this object, according to one aspect of the invention, a cam comprises a small cam portion with which one end of an elastic member is engageable, and a large cam portion which is engaged with the small cam portion integrally and coaxially, and in the side surface of the large cam portion facing the small cam portion, there is provided a guide portion which is formed in a concavo-convex curved surface with respect to the direction of the elastic member. Therefore, since the one end of the elastic member is engaged with the small cam portion as well as the the guide portion of the large cam portion and loads applied to the cam can be dispersed in its radial and axial directions, the handle operation load in the invention can be reduced over the above-mentioned prior art device.

It is another object of the invention to provide an improved lumbar support device which is able to vary the longitudinal curvature of the above-mentioned elastic member by operating or turning the handle slightly, that is, a device which can adjust the hardness of the lumbar support portion of a vehicle seat by slightly rotating the handle.

In attaining this object, according to an another aspect of the invention, the cam comprises a small cam portion which is an eccentric cam and a large cam portion having a guide section formed in a concavo-convex curved surface in its side surface, and thus the elastic member can be pushed out in its longitudinal direction by double displacements, that is, the displacement of the small cam portion and the displacement of the concavo-convex curved guide section in the large cam portion. Therefore, slight rotation of the handle can vary the longitudinal curvature of the elastic membber so as to adjust the hardness of the lumbar support portion of the seat.

Other and further objects, features and advantages of the invention will appear more fully from the following description.

DETAILED DESCRIPTION OF A PREFERRED EMBODIMENT OF THE INVENTION

Figure 2:
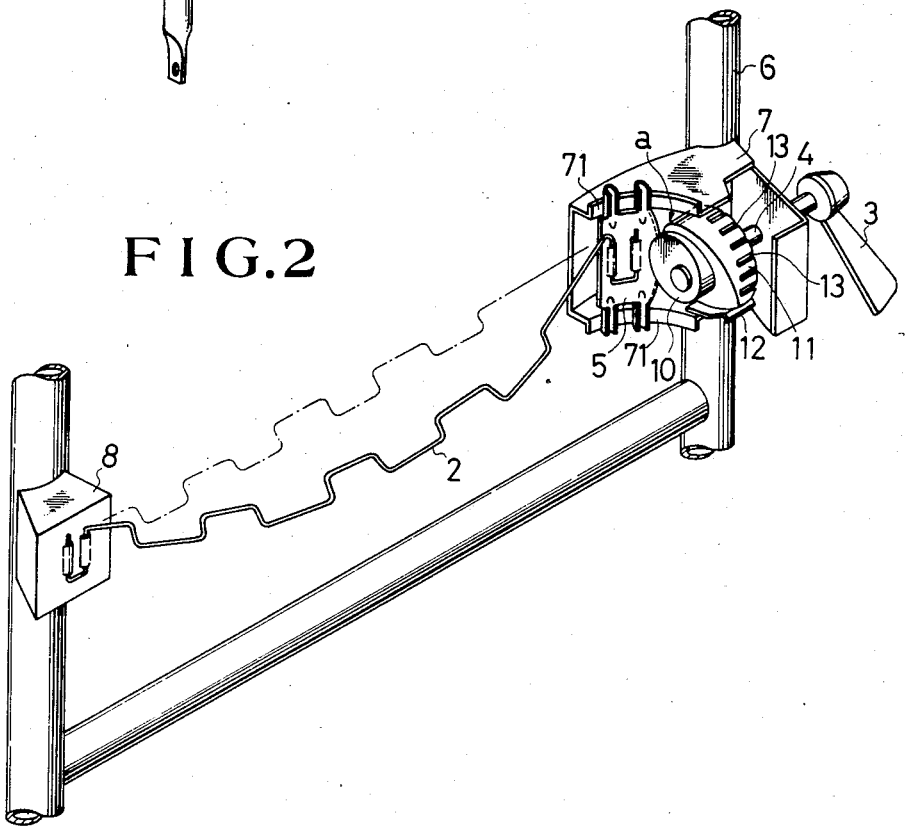
FIG. 2 is a perspective view of a lumbar support device constructed in accordance with the invention.

FIG. 2 illustrates a lumbar support device according to the invention and, in the drawings, like reference characters designate like parts throughout. To a shaft of rotation (4) is mounted a cam (a) comprising a smaller cam portion (10) and a larger cam portion (11) integrally engaged with each other. A slide piece (5) mounted to one end of an elastic member (2) is engaged with the side of the smaller cam portion (10) facing the larger cam portion (11) by means of the elasticity of the elastic member (2). The slide piece (5) and the shaft of rotation (4) are mounted to a bracket (7) fixed to a seat frame (6).

Figure 1:
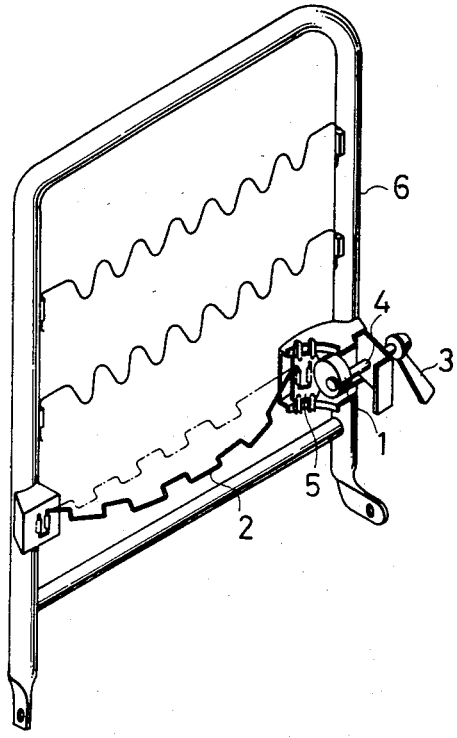
FIG. 1 is a perspective view of a conventional lumbar support device.

The elastic member (2) is curvedly provided extending between the slide piece (5) and a mount piece (8) mounted at the opposite side of the seat frame (6) so as to be expandable forwardly of a seat back, and it is also arranged such that its curvature can be altered with the displacements of the slide piece (5) caused by rotat-ion of the cam (a). That is, if the slide piece (5) is moved in the direction of the mount piece (8), then the elastic member (2) is curved in a general arc, as shown by a solid line in FIG. 2, to increase the support pressure in the lumbar support portion of the seat back. If the slide piece (5) is displaced in the opposite direction, as shown by a two-dot chained line in FIG. 1, the elastic member (2) then takes a curved form but similar to a straight line, so that the support pressure in the lumbar support section of the seat back is decreased. In brief, in the invention, the support pressure of the lumbar support portion of the seat back can be adjusted by varying the curvature of the elastic member (2).

Figure 4:
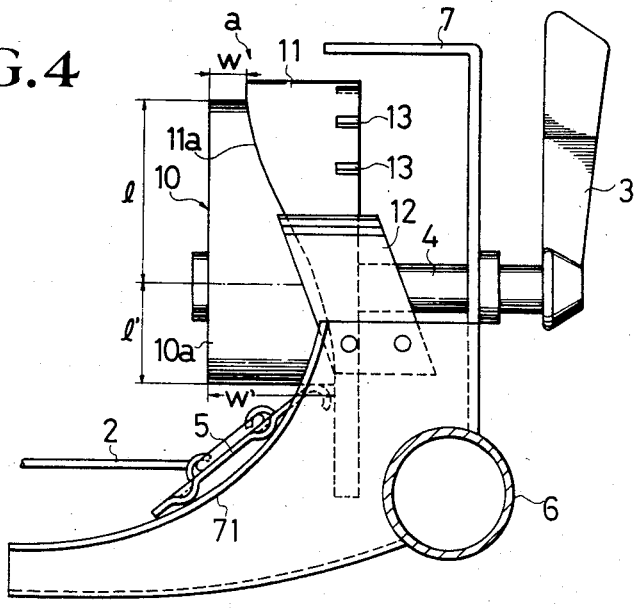
FIG. 4 is a section view taken along line X—X in FIG. 3.

The smaller cam portion (10) and the larger cam portion (11) forming the cam (a) are respectively formed of two small and large plate cams with the smaller cam portion (10) being disposed at the side of the elastic member (2); the thickness (10*a*) of the smaller cam portion (10) is not regular due to the shape of the larger cam portion (11). In particular, in the side of the larger cam portion (11) facing the smaller cam portion (10) there is provided a guide section (11*a*) so formed that it has a concavo-convex curved surface with respect to the direction of the elastic member (2). Thanks to this guide section (11*a*), the thickness (10*a*) of the smaller cam portion (10) can be changed in accordance with distances (1),(1') between the rotation shaft (4) of the smaller cam portion (10) and the contact points of the smaller cam portion (10) with the slide piece (5), as shown in FIG. 4. In other words, the thickness (w) of the furthest portion (1) from the rotation shaft (4) of the smaller cam portion (10) is narrower, and the thickness (w') of the nearer portion is wider. It is noted that the larger cam portion (11) is a concentric circle with respect to the shaft of rotation (4).

The slide piece (5) of the above-mentioned elastic member (2) is slidably mounted to guide pieces (71),(71) of a bracket (7) such that the slide piece (5) can be engaged with the contact surface of the cam (a) at an angle of approx. 45 deg.

The larger cam portion (11) is formed in it rotational direction with a great number of recessed engagement grooves (13),(13),—, with which a brake shoe made of a plate spring can be engaged. Namely, the brake shoe (12), due to its elasticity, presses against the peripheral surface of the larger cam portion (11) to control the rotation of the cam (a).

Figure 3:
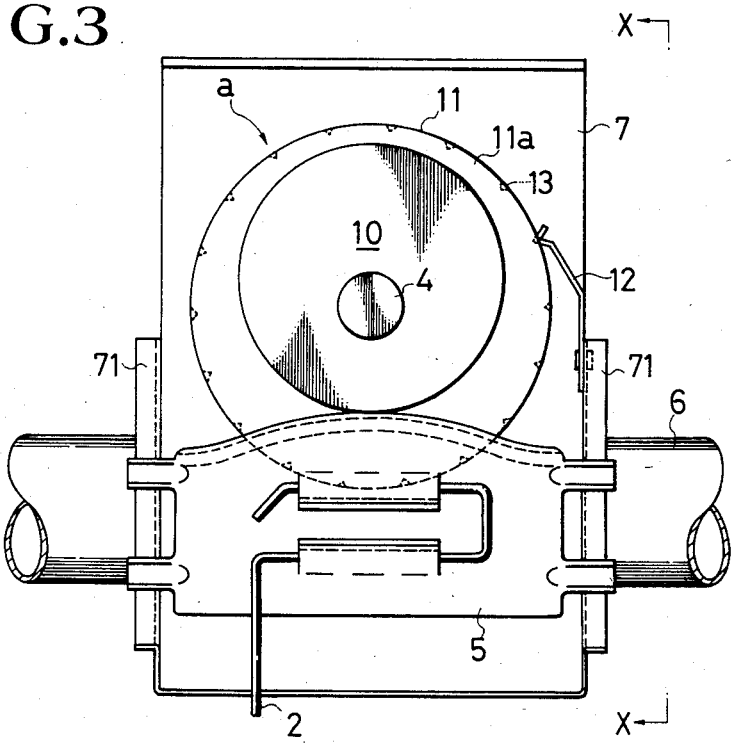
FIG. 3 is a front view of the above device.
Figure 5:
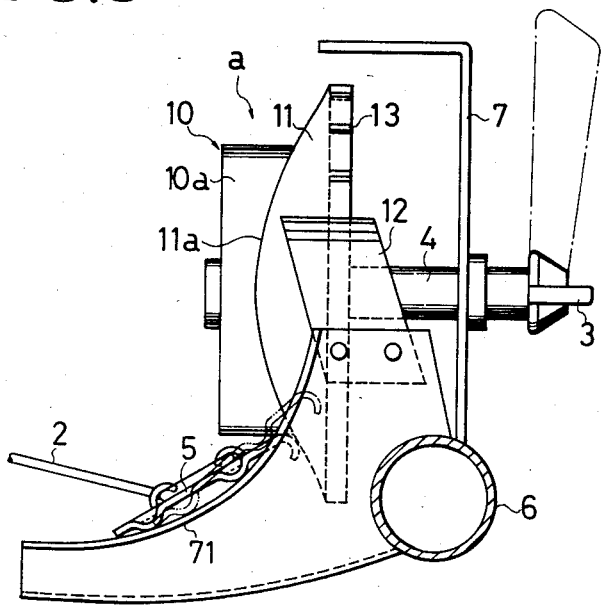
FIGS. 5 and 6 are respectively side views of the invention, illustrating the operation of a cam employed in the invention.
Figure 6:
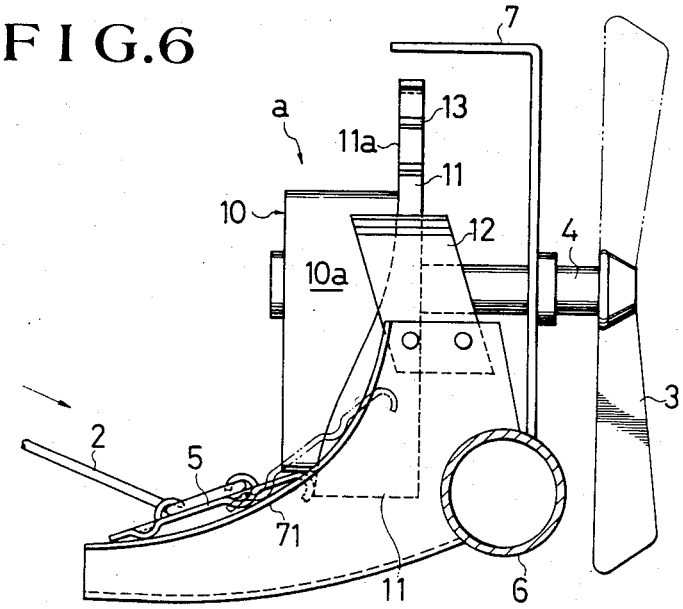

FIGS. 3 and 4 respectively illustrate a state of the seat back in which the support pressure of its lumbar support portion is smaller (that is, a state thereof in which its lumbar support portion is softer), and in this state the slide piece (5) mounted to one end of the elastic member (2) is in abutment against the guide section (11*a*) of the larger cam portion (11) in the smaller cam portion (10) due to the elasticity of the elastic member (2). Then, if a handle (3) is turned, then the cam (a) is rotated. As a result of this, the slide piece (5) is moved along the guide section (11*a*) of the larger cam portion (11) and thus is pushed out to cause the elastic member (2) to be curved, so that the support pressure of the lumbar support portion of the seat back is increased, (FIGS. 5 and 6). The amounts of displacement of the above-mentioned slide piece (5) are the sum of the displacement of the smaller cam portion (10) and the concavo-convex depth in the guide section (11*a*) of the larger cam portion (11).

As described above, according to the invention, the cam is composed of the smaller and larger cam portions and in the side surface of the larger cam portion facing the smaller cam portion there is provided the guide section having the concavo-convex curved surface with respect to the direction of rotation of the cam, so that the load applied to the cam can be dispersed in the axial direction of the rotational shaft as well as in a direction orthogonal thereto. Therefore, the load necessary for operation of the handle can be reduced and also the force to restrict the rotation of the cam can be decreased, which results in the use of a simpler brake device and permits adjustments of the support pressure of the lumbar support portion of the seat back at desired positions and in a continuous manner. Also, since the invention is simple in structure, it is substantially free from failure and can be supplied at a low cost.

What is claimed is:

1. A lumbar support device for adjusting the hardness of the lumbar support portion of a seat back by rotating a cam to move one end of an elastic member extending the right and left sides of a back frame and thus varying the curvature of said elastic member, wherein said cam comprises a smaller cam portion with which said one end of said elastic member can be engaged and a larger cam portion engaged with said smaller cam portion and mounted to the same shaft therewith, and, in the side surface of said larger cam portion facing said smaller cam portion, there is provided a guide section having a concavo-convex curved surface with respect to the direction of said elastic member.

2. The lumbar support device as set forth in claim 1, wherein a slide piece is mounted to said one end of said elastic member and said slide piece is engaged with said smaller cam portion at an angle of approximately 45 degrees.

3. The lumbar support device as set forth in claim 1, wherein said larger cam portion is formed in its outer peripheral surface with a large number of engagement grooves and a brake shoe made of a plate spring can be engaged with one of said engagement grooves to restrict the rotation of said cam.

4. The lumbar support device as set forth in claim 1, wherein said slide piece mounted to said one end of said elastic member is in engagement with both said smaller cam portion and said guide section of said larger cam portion by means of the elasticity of said elastic member.

5. The lumbar support device as set forth in claim 1, wherein the portion of said guide section to be projected furthest in the direction of said elastic member is located at the portion of the outer peripheral surface of said smaller cam portion that is furthest from the rotational shaft of said smaller cam portion.

* * * * *